United States Patent [19]

Bonnamour

[11] 4,204,568

[45] May 27, 1980

[54] METHOD OF PROLONGING THE LIFE OF A ROTARY CASTING MACHINE BAND

[75] Inventor: Yves B. Bonnamour, Carrollton, Ga.

[73] Assignee: Southwire Company, Carrollton, Ga.

[21] Appl. No.: 875,361

[22] Filed: Feb. 6, 1978

Related U.S. Application Data

[62] Division of Ser. No. 741,829, Nov. 15, 1976, Pat. No. 4,082,136.

[51] Int. Cl.[2] ..... B22D 11/06

[52] U.S. Cl. ..... 164/87

[58] Field of Search ..... 164/87, 433, 429, 431

[56] References Cited

U.S. PATENT DOCUMENTS

| | | | |
|---|---|---|---|
| 3,261,059 | 7/1966 | Properzi | 164/433 |
| 3,318,367 | 5/1967 | Bray | 164/433 |
| 3,321,007 | 5/1967 | Cofer et al. | 164/433 X |
| 3,336,972 | 8/1967 | Cofer et al. | 164/433 |
| 3,583,474 | 6/1971 | Properzi | 164/433 |
| 3,642,055 | 2/1972 | Nighman | 164/433 X |
| 3,719,224 | 3/1973 | Lanque | 164/433 |

*Primary Examiner*—Robert D. Baldwin
*Assistant Examiner*—John S. Brown
*Attorney, Agent, or Firm*—Herbert M. Hanegan; Stanley L. Tate; Robert S. Linne

[57] ABSTRACT

A rotary casting machine with an improved translatable band comprising a rigid frame with a rotary casting wheel having a peripheral groove mounted on the frame, the band and the wheel being relatively moveable to move "damaged" surface areas of the band out of contact with the wheel and present "new" surface areas for molding purposes. An endless band frictionally engages a portion of the wheel, the band having a width greater than the width of the casting wheel. Guide rollers on the frame orient the band properly on the frame and into cooperation with the groove of the casting wheel so as to form a mold. A power source drives the casting wheel and the frictionally engaged endless band. A spout is provided for the addition of molten metal to the groove and band mold. A pusher is provided to adjustably translate the band laterally across the peripheral groove of the casting wheel. In the preferred embodiment, the guide rollers have a width substantially equal to the band width and are reciprocally mounted on the frame. An alternative embodiment provides fixed shaft guide rollers wider than the band and a reciprocation shaft on which the band guide is mounted. Thus, the guide wheels are fixed, and the band guide moves the band to effect lateral translation.

3 Claims, 9 Drawing Figures

METHOD OF PROLONGING THE LIFE OF A ROTARY CASTING MACHINE BAND

CROSS-REFERENCE TO RELATED APPLICATIONS

This application is a division of my copending application, Ser. No. 741,829, filed Nov. 15, 1976, now U.S. Pat. No. 4,082,136.

BACKGROUND OF THE INVENTION

1. Field of the Invention

The present invention relates to a method of prolonging the operative life of an imperforate endless metallic band of the type used in casting machines which produce a continuously cast metal product by molding molten metal between a continuous band and a cooperating groove of a rotary casting wheel.

2. General Background

In continuous casting machines of the rotary mold and belt type, the endless band is periodically in contact with molten metal at its pouring point and as it quickly cools. As a result, the band experiences severe thermal stresses. One of the major reasons for stopping the casting is the failure of some components, mainly this band, which sustain high thermal stress. The stresses are normally applied in a longitudinal zone of the band. Thermal stresses due to the hot metal on one side and cooling on the other side of the band cause cracks to appear in this longitudinal zone. After the cracks have appeared, the cooling fluid and/or the molten metal can seep through the cracks whereupon the casting operation must be ceased. Thus, it is of great importance to attempt to increase the life of the band as much as is possible so that the casting operation can be continuous for a maximum period of time.

3. Prior Art

Several techniques have been suggested to increase the life of the band, such as increasing its length and putting a protective coating on the band. These methods can be used separately or together.

Examples of prior art casting machines teaching various improvements are disclosed in the following table:

| PRIOR ART PATENTS | | |
|---|---|---|
| U.S. PAT. NO. | INVENTOR(S) | ISSUE DATE |
| 3,318,364 | T. L. Bray et al. | May 9, 1967 |
| 3,318,367 | T. L. Bray | May 9, 1967 |
| 3,336,972 | D. B. Cofer et al. | Aug. 22, 1967 |
| 3,811,492 | G. C. Ward | May 21, 1974 |

The foregoing prior art patents are all assigned to Southwire Company, the assignee of the present application.

SUMMARY OF THE INVENTION

The present invention relates to a third method for increasing the life of the band, namely to increase the band's width.

In the preferred embodiment of the present invention, an extra large width band is transversely moved so that cracks that may appear do not go back in contact with the hot metal once they have appeared. The band can be transversely displaced with respect to the mold groove in several ways, two different embodiments being herein described. To achieve transverse motion of the band, the two methods disclosed are: (a) to use support wheels for the band with an equal width and to transversely move these wheels; and (b) to use extra wide support wheels for the band and then transversely push the band with a band guide. Alternatively but less preferred, the molding wheel could be transversely moved with respect to the extra large width band which is transversely fixed; or a combination of relative movement could be provided.

The method of the present invention can also, it is believed, be applied to a twin belt type casting machine.

BRIEF DESCRIPTION OF THE DRAWINGS

For a further understanding of the nature and object of the present invention, reference should be had to the following detailed description, taken in conjunction with the accompanying drawings, in which like parts are given like reference numerals and wherein.

DETAILED DESCRIPTION OF THE PREFERRED EMBODIMENTS

Figure 1:
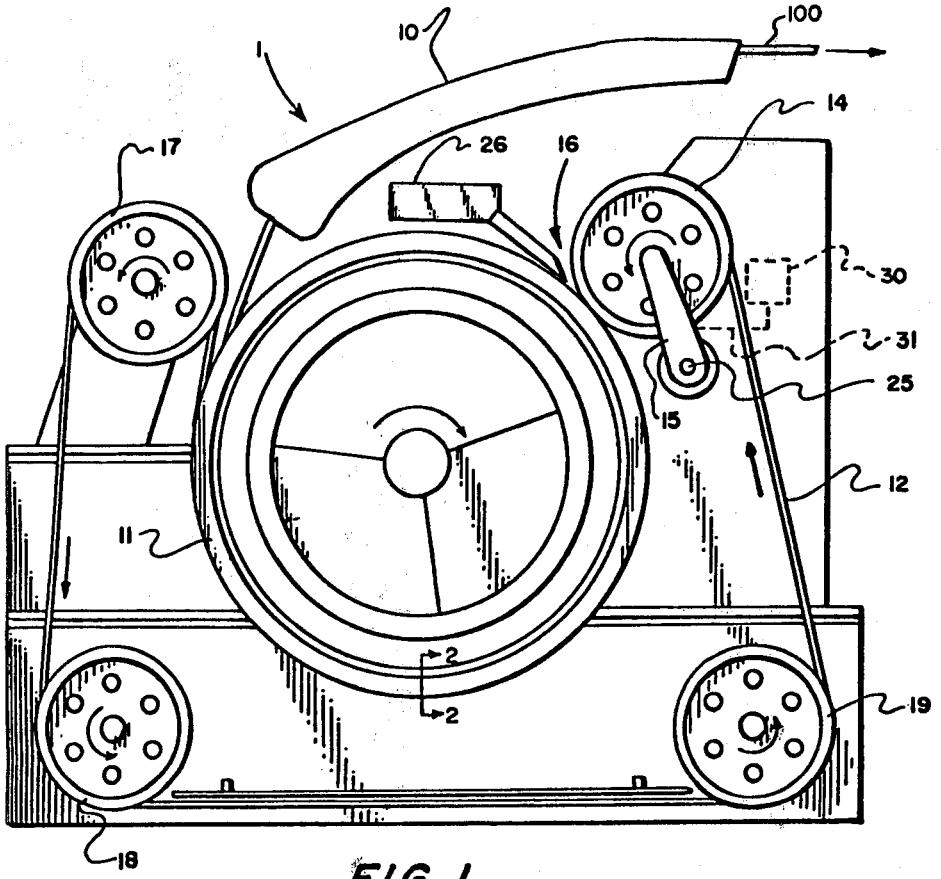
FIG. 1. (PRIOR ART)
FIG. 1 is an elevational view of a standard, prior art casting machine for continuously casting metal wherein the inner surface of the band is passed around the casting wheel, and the outer surface of the band is engaged by a pivotally mounted combined pressure-band guide wheel and three band guide wheels.

Referring now to the drawings, FIG. 1 illustrates a conventional type prior art rotary casting machine 1 as disclosed in U.S. Pat. No. 3,811,492, issued May 21, 1974 to George C. Ward and assigned to Southwire Company. Such a prior art machine represents a typical application to which the present invention can be applied, although of course certain modifications would have to be made to the machine. FIG. 1 shows a casting wheel 11 engaged by band 12 to form an annular mold cavity (see FIG. 2). Pour spout 26 is positioned above casting wheel 11 such that molten metal pours into the annular mold cavity formed by casting wheel 11 and band 12 at point 16. Pressure-band guide wheel 14 is mounted for rotation on pivot arm 15 about pivot point 25. Conventional means of moving pivot arm 15 away from casting wheel 11, thereby decreasing tension in band 12 and lessening the contact between band 12 and casting wheel 11 at point 16, and for moving pivot arm 15 toward casting wheel 11, thereby increasing the tension in band 12 and pressing band 12 into closer contact with the casting wheel 11 at point 16 are contained in the casting machine behind pivot point 25.

Such conventional means are illustrated schematically in FIG. 1 as including a motive source 30 and connecting arm 31.

Band 12 is further supported by band guide wheels 17,18 and 19 and travels in a clockwise direction, i.e., around casting wheel 11 in a direction of guide wheel 17, then around guide wheels 17, 18, 19 and pressure-band guide wheel 14. As band 12 tension is increased, pressure-band guide wheel 14 is moved into tighter contact with casting wheel 11 at point 16. Variable pressure is applied at point 16 by adjusting the tension on band 12, thereby lessening air contact with the molten metal entering annular mold cavity at point 16.

Cast metal removing means 10 are provided to remove the cast metal bar 100 from the wheel 11 in a continuous manner.

Figure 2:
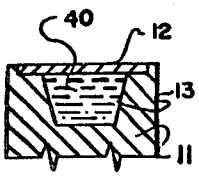
FIG. 2. (PRIOR ART)
FIG. 2 is a sectional view, taken along section lines 2—2 of FIG. 1, illustrating the outermost portion of a standard, prior art casting wheel and the continuous band which contacts the casting wheel forming a mold cavity between the two filled with hot metal.
Figure 2A:
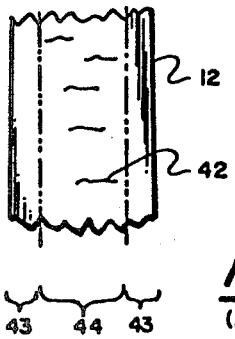
FIG. 2A. (PRIOR ART)
FIG. 2A is a partial, plan view of the prior art type band of FIG. 2.

As can be best seen by FIGS. 2–2A, a mold cavity 40 is formed between prior art band 12 and the peripheral groove 13 of casting wheel 11. FIG. 2A illustrates the zone 44 exposed to hot metal on band 12. Thermal cracks 42 appear on band 12 after the band has undergone extensive use. These cracks can permit either cooling fluid or the molten metal or both to flow through the cracks into the mold or vice versa. This zone of thermal stress is designated by the numeral 44 in FIG. 2A. FIG. 43 designates the outermost zones of band 12 which normally do not undergo the highest thermal stress as does area 44.

Figure 3:
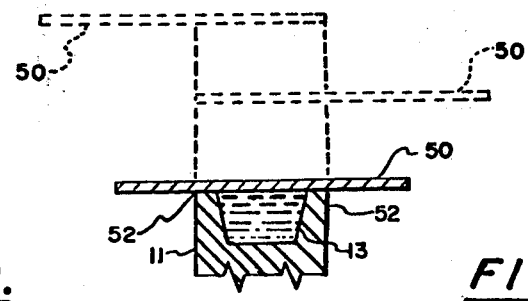
FIG. 3 is a sectional view of the outermost position of the casting wheel and extra wide band comprising a first, preferred embodiment of the present invention, illustrating the various extreme band positions in phantom line on the casting wheel and the mold cavity formed therein.
Figure 3A:
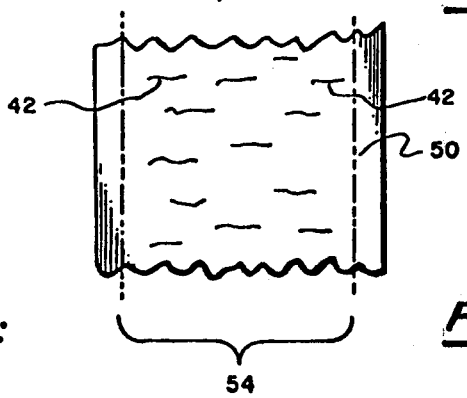
FIG. 3A is a partial plan view of the band of FIG. 3.

FIGS. 3 and 3A illustrate a preferred embodiment of the apparatus of the present invention, which utilizes a band 50 with an extra width as can be seen by the drawings. The extra wide band 50 is translatable across the tip portions 52 of casting wheel 11 thereby contacting a substantial portion of band 50 with hot metal and the corresponding thermal stress. This relatively large available zone for resisting thermal stress is designated by the numeral 54 in FIG. 3A. The extra wide band 50 of the present invention is thus substantially larger than the width of wheel 11, a factor of approximately two being exemplary. FIG. 3 also illustrates examples of the extreme lateral band positions (note phantom lined elements 50) in the apparatus of the present invention where the extra width band 50 is translated across the tip portions 52 of casting wheel 11. In operation, the band is normally held in one position until thermal cracks 42 appear. The band 50 is then moved over far enough to remove the thermal cracks from the portion of the band which is in contact with groove 13. Thus, the band 50 can be translated several times until thermal cracks appear over the entire width before a "shut down" is necessary, to permit the installation of a replacement band.

Figure 4:
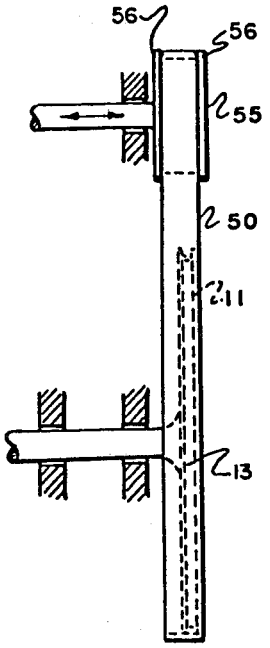
FIGS. 4 and 4A are partial, sectional elevation views of the apparatus of the first, preferred embodiment of the present invention of FIG. 3.
Figure 4A:
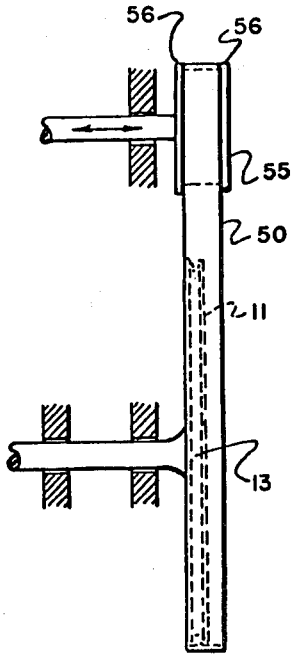

FIGS. 4 and 4A illustrate a first preferred embodiment of the apparatus of the present invention. In this embodiment extra wide band 50 is translated across the peripheral groove 13 of casting wheel 11 by means of laterally moveable guide wheels (one such wheel 55 being illustrated), each having a working width corresponding to the width of band 50. Flanges 56 retain band 50 on guide wheel 55. Guide wheels 55 in this embodiment can be moved laterally back and forth to position the desired "new" surface area over the casting groove 13. (See arrows, FIGS. 4–4A.)

Figure 5:
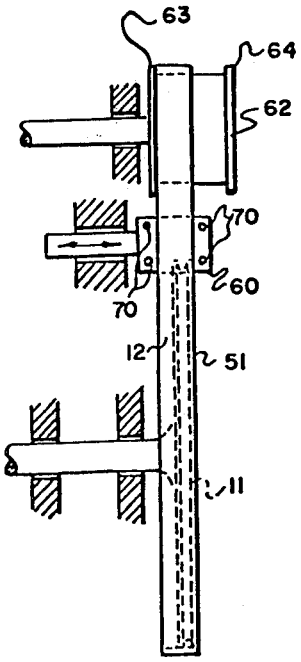
FIGS. 5 and 5A are partial, sectional elevation views of an alternative embodiment of the apparatus of the present invention.
Figure 5A:
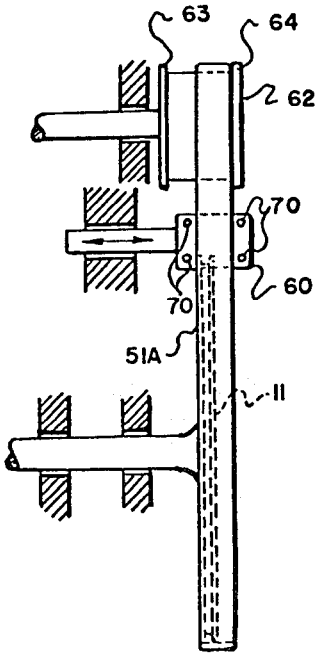

FIGS. 5–5A illustrate an alternative method and apparatus for translating band 50 on casting wheel 11. In this alternative embodiment, a translatable band guide 60 is utilized in conjunction with extra wide, laterally fixed guide wheels (one such wheel 62 being illustrated). Band guide 60 reciprocates (see arrows, FIGS. 5–5A) to move band 50 across both casting wheel 11 and extra wide, guide wheels 62. As can be seen in FIG. 5, band guide 60 is in an inward position holding band 50 on the innermost flange 63 of guide wheel 62, and the band 50 is contacting casting wheel 11 at the extreme edge portion 51 of band 50. In FIG. 5A, band guide 60 has reciprocated to a second position in which band 50 has translated across both guide wheel 62 and casting wheel 11 so that band 50 abuts the outer flange 64 of guide wheel 62, and the opposite side portion 51*a* of band 50 is now contacting casting wheel 11.

Band guide 60 is provided with projecting rotatable fingers 70 which engage the edges of band 50 when guide 60 urges band 50 as required across the surface of support wheel 62 and casting wheel 11.

Utilizing the method of the preferred embodiments, the band is thus transversely moved so that the cracks as they appear do not go back in contact with hot metal. This maximizes the operating time and increases the life of the band, thereby eliminating unnecessary and costly shut downs of the entire casting operation.

Alternatively but less preferred, the molding wheel could be transversely moved with respect to the extra large width band which is transversely fixed; or a combination of relative movement could be provided.

The above, are, of course merely exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A method of prolonging the operative life of an imperforate endless metallic band of the type used to close a peripheral groove in a rotating casting wheel of a casting machine adapted to the continuous casting of molten metal, comprising the steps of:

providing an imperforate endless band having a lateral width substantially greater than twice the lateral width of the peripheral groove of the casting wheel; and contacting the peripheral groove with a first lateral surface area of said band; then contacting said groove with a substantially different second lateral surface area of said band by laterally shifting sand band and casting wheel relatively of each other by an amount equal to at least the lateral width of said groove, whereby thermal cracks in said first lateral surface area of said band, caused by prolonged contact of said band with molten metal in said groove, are avoided and subsequent thermal cracks are distributed over a substantial portion of the second lateral surface area of said band.

2. The method of claim 1 wherein said band is laterally shifted relative to said casting wheel by a reciprocating band guide translating means including rotatable fingers for engaging the lateral edges of said band for urging said band across the groove.

3. The method of claim 1 wherein said band is laterally shifted relative to said casting wheel by a plurality of rotatable band guide wheels, having flanges for engaging the lateral edges of said band, mounted on shafts adjacent said casting wheel and reciprocable laterally of said casting wheel.

* * * * *